US007678243B2

(12) United States Patent
Silinger et al.

(10) Patent No.: US 7,678,243 B2
(45) Date of Patent: Mar. 16, 2010

(54) INTERNAL HEAT SPREADER PLATING METHODS AND DEVICES

(75) Inventors: Paul Silinger, Spokane, WA (US); Mark Fery, Spokane, WA (US)

(73) Assignee: Honeywell International Inc., Morristown, NJ (US)

( * ) Notice: Subject to any disclaimer, the term of this patent is extended or adjusted under 35 U.S.C. 154(b) by 709 days.

(21) Appl. No.: 10/765,782

(22) Filed: Jun. 11, 2003

(65) Prior Publication Data

US 2004/0154927 A1 Aug. 12, 2004

(51) Int. Cl.
*C25D 17/00* (2006.01)

(52) U.S. Cl. ..... 204/211; 204/198; 205/96; 205/137

(58) Field of Classification Search ..... 205/83, 205/96, 146; 204/211, 232, 237, 245, 255, 204/257, 198, 194
See application file for complete search history.

(56) References Cited

U.S. PATENT DOCUMENTS

| | | | | |
|---|---|---|---|---|
| 2,859,166 | A * | 11/1958 | Grigger | 204/279 |
| 4,372,825 | A | 2/1983 | Eidschun | 204/27 |
| 4,443,304 | A | 4/1984 | Eidschun | 204/27 |
| 4,534,832 | A | 8/1985 | Doiron | 204/15 |
| 4,772,371 | A | 9/1988 | Lace et al. | 204/211 |
| 4,879,007 | A * | 11/1989 | Wong | 205/137 |
| 5,516,412 | A * | 5/1996 | Andricacos et al. | 204/224 R |
| 6,132,583 | A * | 10/2000 | Stone | 205/96 |
| 6,402,923 | B1 * | 6/2002 | Mayer et al. | 205/96 |

FOREIGN PATENT DOCUMENTS

| | | |
|---|---|---|
| JP | 59-24767 | 2/1984 |
| JP | 59-125975 | 8/1984 |
| JP | 08-296086 | 11/1996 |
| JP | 08296086 A * | 11/1996 |
| JP | 09-265194 | 9/1997 |
| JP | 10-168600 | 6/1998 |
| JP | 11-330326 | 11/1999 |

* cited by examiner

*Primary Examiner*—Nam X Nguyen
*Assistant Examiner*—Luan V Van

(57) ABSTRACT

An improved plating system comprises a plurality of non-electrically conductive shields forming an elongated upper channel and an elongated lower channel, the upper and lower channels each having a width less than or equal to one inch; a plurality of part holding clamps electrically coupled to a power source and positioned within the upper channel or the lower channel; a plating solution sparger comprising a series of inlets oriented to direct any plating solution flowing through the inlets into the lower channel and towards the upper channel; and a plurality of anodes positioned outside and along the length of the upper and lower channels. An improved method of plating a work piece comprises: submerging a work piece to be plated in a volume of plating solution; positioning a work piece to be plated at least partially within an upper plating channel and a lower plating channel, the upper and lower plating channels comprising non electrically conductive sides, the channels being positioned opposite each other and being separated from each other, the separation between the channels forming a pair of solution egress slots positioned approximately over the center of the work piece to be plated; causing electrical current to flow between the work piece and one or more anodes, the current flow passing through the solution egress slots; and moving the work piece to be plated along the length of the plating channels to form one or more internal heat spreaders on a surface of the work piece which is essentially parallel to the shields.

8 Claims, 3 Drawing Sheets

FIG. 1
PRIOR ART
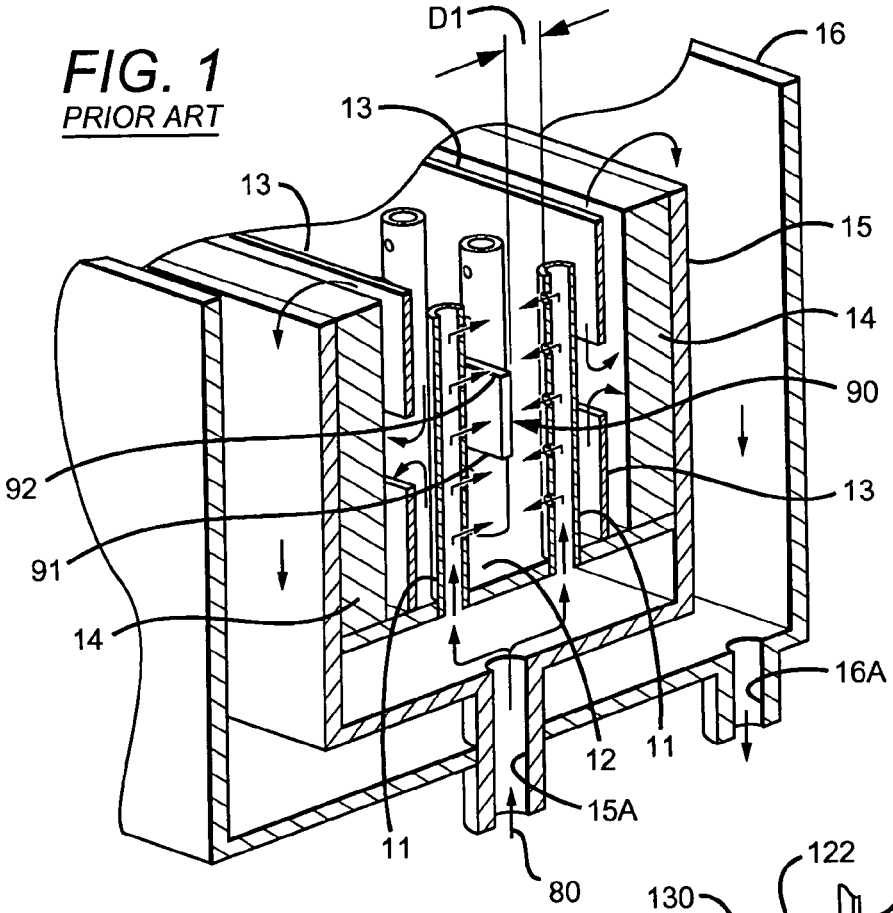
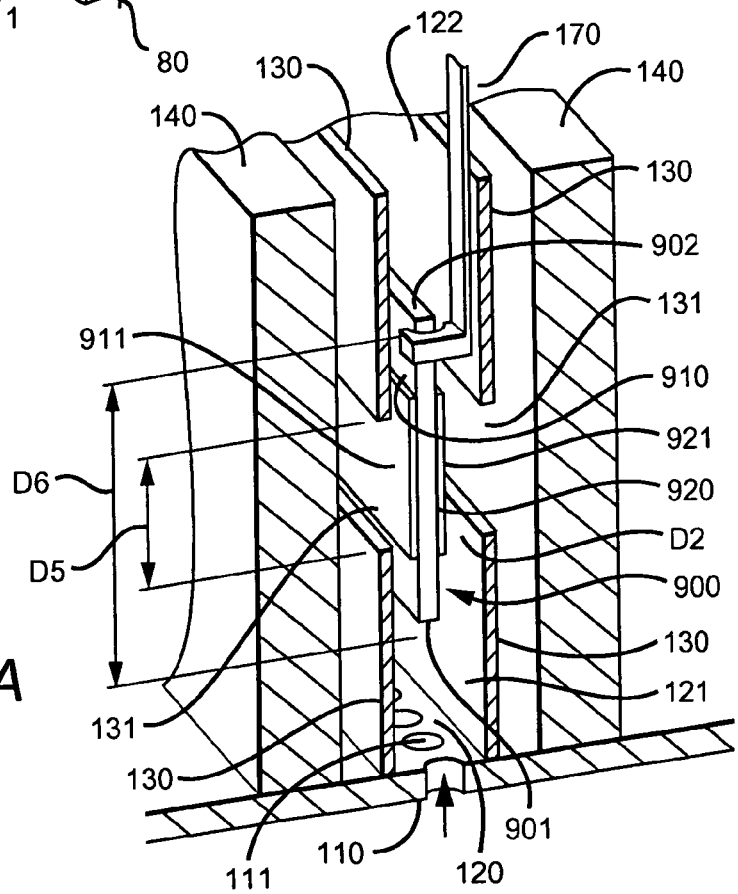
FIG. 2A

INTERNAL HEAT SPREADER PLATING METHODS AND DEVICES

This application claims the benefit of PCT application number PCT/US02/05536 filed on Feb. 21, 2002 and European application number 02707865.8 filed on Jul. 3, 2003, incorporated herein by reference in its entirety.

FIELD OF THE INVENTION

The field of the invention is methods of plating heat spreaders and other parts designed for thermal management of semiconductor devices.

BACKGROUND OF THE INVENTION

A common continuous plating system comprises an elongated plating chamber/cell and a movement mechanism designed to move parts along the length of the cell while the parts are being plated. The chamber is sufficiently long so that the plating of a part which enters the chamber at one end and exits at the other can be completed by the time the part traverses the length of the chamber.

Referring to FIG. 1A, previously known plating systems such as the MP 300 available from Technic Inc. utilize vertical solution spargers 11 to introduce plating solution 80 into the plating compartment 12 and to direct the incoming solution 80 towards the parts 90 being plated. Known systems also use electrically insulating shields 13 to manipulate the flow of current between the cathode/part 90 and one or more anode baskets 14. As shown in FIG. 1, the distance D1 between the shields 13 and the part being plated 90 is sufficiently great so as to allow the part 90 to be moved between vertical spargers 11 which are placed between the part 90 and the shields 13. Systems similar to those of FIG. 1 are typically used to plate a single edge 91 of a printed circuit board 90 with the edge being plated 91 being submerged in the plating solution 80 and the opposite edge 92 being positioned out of the plating solution 80. Systems similar to those of FIG. 1 typically comprise an inner cell 15 used for plating, an outer cell 16 for solution return, one or more fluid inlets 15A and one or more fluid outlets 16A. Fluid typically enters inner cell 15 via fluid inlet 15A, flows out of inner cell 15 and into outer cell 16, and then flows out of out cell 16 via fluid outlet 16A.

Unfortunately, whether previously recognized or not, systems similar to those of FIG. 1 do not always provide optimum metal distribution over a work piece. As such, there is a need for plating systems having improved metal distribution.

SUMMARY OF THE INVENTION

The present invention is directed to improved plating systems and methods such as an improved plating system comprising an elongated upper channel and an elongated lower channel, and a plating solution sparger comprising a series of inlets oriented to direct any plating solution flowing through the inlets into the lower channel and towards the upper channel. A preferred embodiment of such a system comprises a plurality of electrically insulating shields forming an elongated upper channel and an elongated lower channel, the upper and lower channels each having a width less than or equal to one inch; a plurality of part holding clamps electrically coupled to a power source and positioned within the upper channel or the lower channel; a plating solution sparger comprising a series of inlets oriented to direct any plating solution flowing through the inlets into the lower channel and towards the upper channel; and a plurality of anodes positioned outside and along the length of the upper and lower channels.

An improved method of plating a work piece comprises: submerging a work piece to be plated in a volume of plating solution; positioning a work piece to be plated at least partially within an upper plating channel and a lower plating channel, the upper and lower plating channels comprising non electrically conductive sides, the channels being positioned opposite each other and being separated from each other, the separation between the channels forming a pair of solution egress slots positioned approximately over the center of the work piece to be plated; causing electrical current to flow between the work piece and one or more anodes, the current flow passing through the solution egress slots; and moving the work piece to be plated along the length of the plating channels to form one or more internal heat spreaders on a surface of the work piece which is essentially parallel to the shields.

It is contemplated that the deposition rate can be greatly increased via the more turbulent solution flow and less cathode-anode restriction found in the systems described herein.

It is contemplated that the use of the plating system described herein to plate the workpieces results in more uniformity in plating between work pieces and less overplating as a result of each part being positioned at the same depth within the cell and having the same shield distribution.

It is contemplated that the methods and devices described herein are particularly suitable for plating entire surfaces of discrete parts, and, more particularly, for plating internal heat spreaders (IHS) or other parts designed for thermal management of semiconductor devices.

Various objects, features, aspects and advantages of the present invention will become more apparent from the following detailed description of preferred embodiments of the invention, along with the accompanying drawings in which like numerals represent like components.

BRIEF DESCRIPTION OF THE DRAWINGS

FIG. 1 is a perspective view of a prior art plating system.

FIG. 2A is a detailed view of a part being plated in the system of FIG. 2.

DETAILED DESCRIPTION

Figure 2:
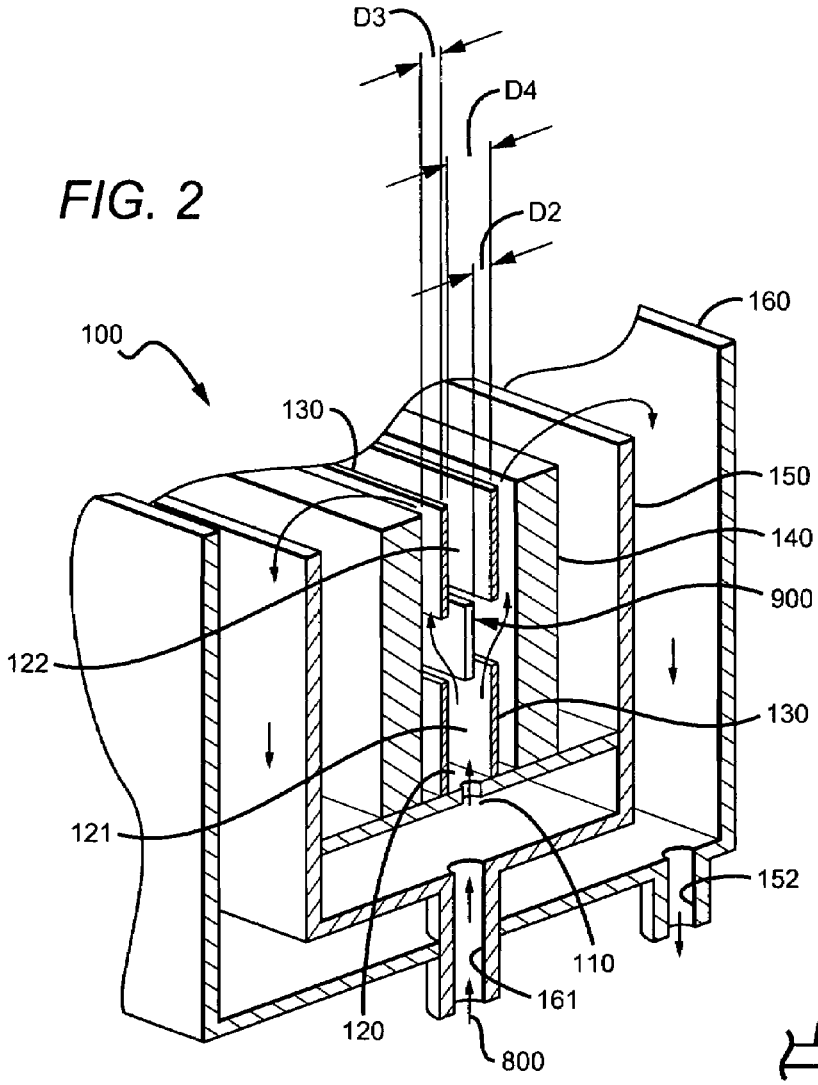
FIG. 2 is a perspective view of a plating system embodying the invention.

An improved plating system 100 is shown in FIG. 2 which provides for improved metal distribution over a work piece 900. In the improved system 100, the vertical spargers (spargers 11 in FIG. 1) found in prior art plating systems are eliminated and fluid 800 enters the chamber 120 through the bottom of the chamber with the bottom of the chamber acting as a horizontal sparger 110. By eliminating the vertical spargers, the distance D2 between the part being plated 900 and the shields 130 can be decreased (with a corresponding decrease in the distance D4 between the fields forming the sides of the channel). It is preferred that the distance D2 between the part being plated 900 and the shields 130 be less than or equal to one inch, or, more preferably, less than or equal to 0.5 inches.

The system of FIG. 2 may be obtained by modifying the system of FIG. 1 (a Technic Inc. MP 300) in the following manner: (1) eliminating the tubular vertical solution spargers and replacing them with holes 111 fabricated in the lower plenum so that solution travels around the parts to be plated as a turbulent flow from the bottom of the parts to the tops, and not from the sides; (2) increasing the solution velocity; (3) moving the shields closer to the parts to be plated (cathodes); (4) incorporating part holding clamps sufficiently narrow so as to adequately hold the part while still permitting the claims and parts to move between the shields; and (5) incorporating a double rinsing and drying process where the plating/part holding fixture is rinsed and dried first, and the plated part and lower half of the fixture are subsequently rinsed and dried.

It is contemplated that the use of one or more horizontal spargers 110 having holes/inlets 111 and being located at an end of a chamber 120 at least partially formed by an upper channel 122 and lower channel 121 to direct fluid flow through a first of the channels and towards a second channel so that it flows toward a part 900 positioned relative to a gap 131 between the channels as shown in FIGS. 2 and 2A will provide for more turbulent fluid flow and a corresponding higher deposition rate. In order to obtain the desired turbulence, it is preferred that the distance D5 between the upper and lower channels (the width of gaps 131) be as low as 20 percent of the height D6 of work piece 900.

In essence, the shields 130 of FIG. 2A form narrow upper and lower plating channels (121 and 122) through which the parts being plated move with each part 900 having one edge 902 positioned within the upper plating channel 122 and an opposite edge 901 positioned within the lower plating channel 121. Because the shields 130 are electrically insulating, current flow between the work piece 900 and the anode baskets 140 is forced to pass through the gaps 131 between the upper and lower shields. Positioning and movement of a part 900 within channel 120 is accomplished by clipping part 900 to a clip 170 and moving clip 170.

Figure 3A:
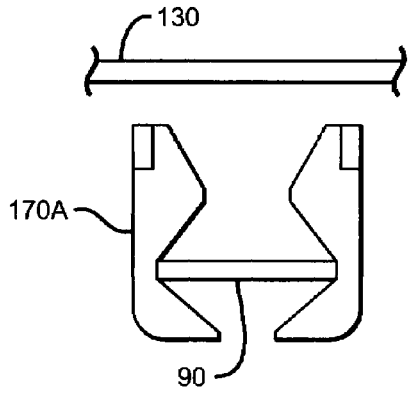
FIG. 3A PRIOR ART
FIG. 3A is a top view of a clip suitable for use in the system of FIG. 1.
Figure 3B:
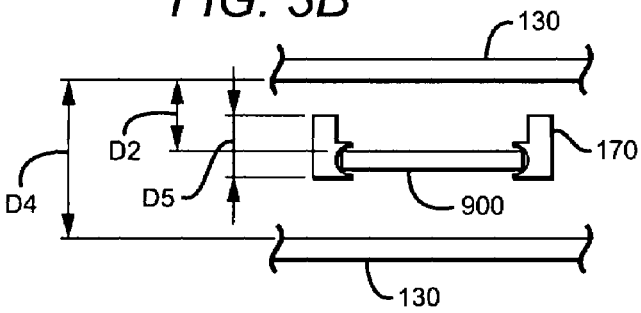
FIG. 3B is a top view of a clip suitable for use in the system of FIG. 2.

FIG. 3A shows the original design of the part holding clamps/clips 170A utilized by the system of FIG. 1 while FIG. 3B shows an improved clip 170 for use in the system of FIG. 2. It should be noted that the clamp design has been modified to permit the distance D2 between the shields and a work piece being held by the clamps to be decreased to 0.5 inches or less by decreasing the thickness D5 of clip 170.

It is contemplated that shielding the work piece/cathode of a plating system by moving the work piece within narrow channels formed by the shield rather than using the shields to shield the anodes by moving the shields closer to the anodes than to the parts being plated results in better distribution of deposited metal on the work pieces. As such, it contemplated that the distance D3 between the shields 130 and the anodes 140 be greater than the distance D2 between a part being plated 900 and the shields 130.

Figure 4:
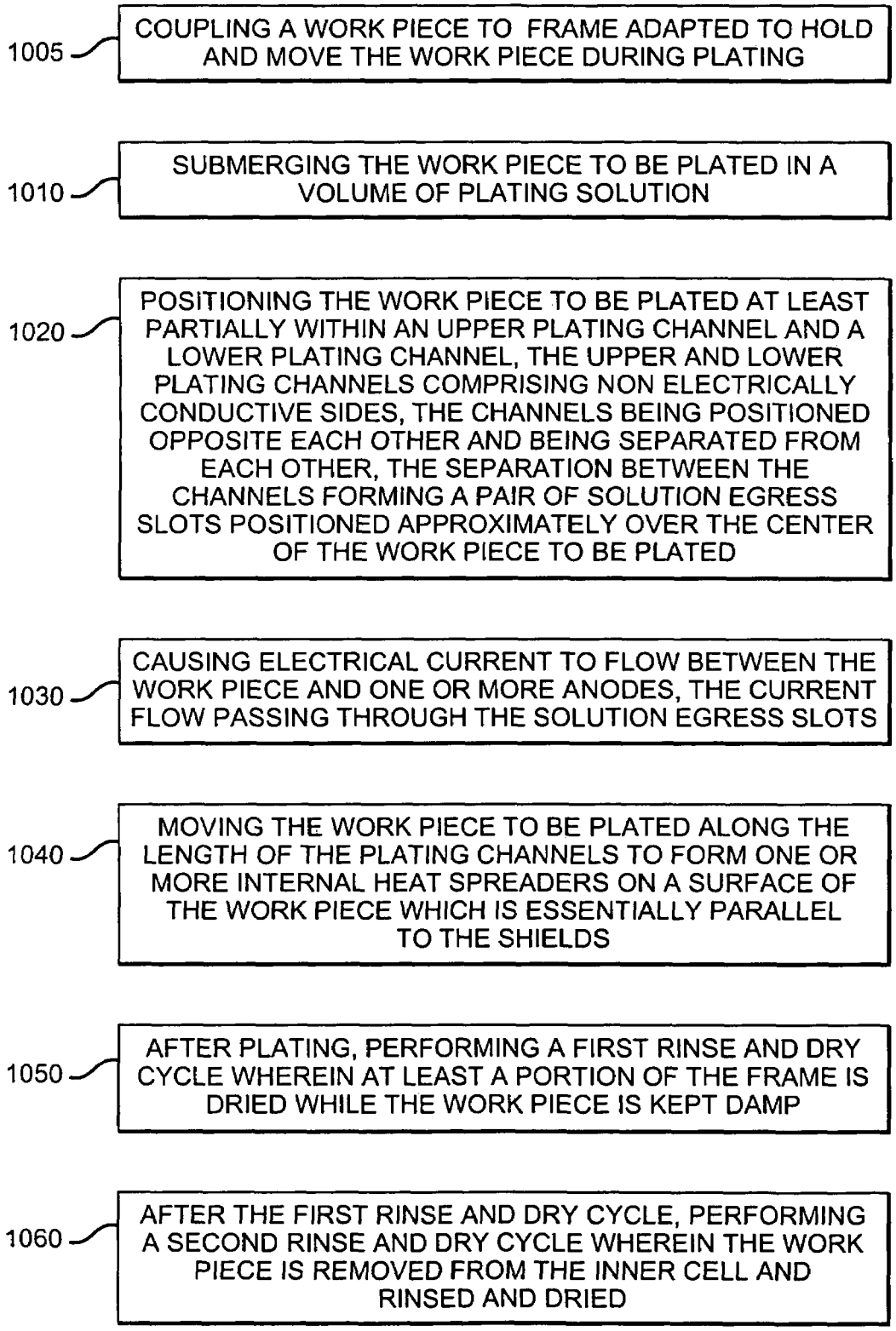
FIG. 4 is a schematic of a method embodying the invention.

A method 1000 of using the system of FIG. 2 may include (see FIG. 4) the following steps: step 1010, submerging a work piece 900 to be plated in a volume of plating solution 800; step 1020, positioning the work piece to be plated 900 at least partially within an upper plating channel 122 and a lower plating channel 121, the upper and lower plating channels comprising non electrically conductive sides (shields 130), the channels 121 and 122 being positioned opposite each other and being separated from each other, the separation between the channels forming a pair of solution egress slots 131 positioned approximately over the center of the work piece 900 to be plated; step 1030, causing electrical current to flow between the work piece 900 and one or more anodes 140, the current flow passing through the solution egress slots 131; and step 1040, moving the work piece 900 to be plated along the length of the plating channels 121 and 122 to form an electrodeposited layer on one or more internal heat spreaders (911, 921). The surface (910, 920) of the work piece 900 is essentially parallel to the shields 130 during this operation.

The forgoing method may further comprise one or more of the following steps: step 1005, coupling the work piece to a frame adapted to hold and move the work piece during plating; step 1050, after plating, performing a first rinse and dry cycle wherein at least a portion of the frame is rinsed and dried while the work piece is kept damp; and step 1060, after the first rinse and dry cycle, performing a second rinse and dry cycle wherein the work piece is removed from inner cell 150 and rinsed and dried. It is contemplated that the use of such a two step process wherein the frame is dried first will result in stain free drying of the work piece because potentially contaminated rinsewater from the clip is not allowed to redeposit onto and/or stain the workpiece.

The following steps may also prove advantageous when used in the foregoing method: a) rinsing the workpiece/part and clip with clean water; b) drying only the clip without regard for staining; c) rinsing the part only with ultra pure water, while keeping the clip dry; d) drying the part. This drying method prevents the possibility contaminated rinsewater from the clips splashing onto the parts during drying causing staining of the heat spreaders.

Variations of this method may include the use of channels having a width of one inch or less and/or including a step of adjusting the width of the slots 131 between the channels to obtain an optimum or at least more uniform plating distribution on the work piece 900.

In preferred embodiments, horizontal sparger 110 will be sized adequately to provide turbulent flow within the channel. Care must be taken to allow sufficient drainage such that the cell does not want to overflow. It is also difficult to achieve turbulent flow over the submerged portion of the clip while not allowing any splashing of the plating fluid onto the portion of the clips above the cell. Any solution that is splashed onto the clips contributes to the previously mentioned rinse-dry concerns.

Chamber 120 is preferred to allow for turbulent flow across the work piece while minimizing surface splashing. This is generally achieved by designing a discharge plenum (horizontal sparger 110) with a series of holes with a given diameter. These holes are drilled in such a manner to direct fluid toward the part contained within the clip. Plating solution is pumped through this plenum through a valve style restrictor, and this valve is adjusted to achieve the maximum flow without causing splashing at the surface of the plating solution. The distance between the discharge plenum and the part, the hole diameter of the discharge plenum and the flow rate through the plenum are all set to maximize turbulent flow at the workpiece while minimizing splashing at the solution surface.

Shields 120 preferably comprise a sheet of electrically insulating material in which a slot has been machined to allow current flow, the slot being centered on the part to be plated. The length of the slot should coincide with the length of the anode from which electrical current is being restricted, and the height of the slot is selected to provide the best metal distribution on the electroplated component. Empirically, a slot of about ¼" allows ample current for plating of a square heat spreader 1¼" on a side. In this example, the shield was moved to within ½" of the clip containing the part for plating.

In preferred embodiments, the solution velocity will be such that it is clearly within the region for turbulent flow. This is important in order to replenish plating electrolyte at the work surface, which is necessary to increase metallic deposition rate. Using the cell described above, deposition rates exceeding 2 microns/minute have been achieved when depositing nickel from sulfamate based electrolyte.

It is contemplated that system 100 is particularly well adapted for use with a metal electrolyte designed to deposit 800 one or more of the following metals: Ni, Au, Ag, Sn, Cu, Pb, In, Bi or alloys of these.

It is contemplated that system 100 may be advantageously used where work piece 900 comprises is one or more copper heat spreaders specifically designed to remove or dissipate heat from semiconductor devices. Alternately, the copper may be replaced with Aluminum, Aluminum-Silicon alloy, kovar alloy 42 or alloys thereof.

Use of the preferred system and or method is contemplated to result in deposition rates of at least 2 microns/minute while maintaining a uniform distribution of metal such that the thickness of the deposited metal varies by less than 1 micron over the surface of the work piece being plated. Sample 31 mm square heat spreaders electroplated with about 4 microns of nickel had a film uniformity of 3.5 microns to 4.5 microns across the part. Identical parts plated without the optimized shielding approach were typically 3 microns at the low point to over 6 microns at the high points.

Thus, specific embodiments and applications of an improved plating system have been disclosed. It should be apparent, however, to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced.

What is claimed is:

1. A continuous plating system comprising:

first and second vertically oriented, spaced anodes that define a plating area;

first and second vertically oriented upper shields positioned in the plating area to define an elongated upper channel;

first and second vertically oriented lower shields positioned in the plating area to define an elongated lower channel, wherein the first and second lower shields are positioned relative to the first and second upper shields to define a gap between the first upper and first lower shields and a gap between the second upper and second lower shields;

a part clamp configured to move one or more parts through the plating area, the part clamp being positioned relative to the plating area such that an upper portion of a part to be plated is positioned in the upper channel, a lower portion of the part is positioned in the lower channel and a height of the gaps is less than a height of the one or more parts; and a plating solution horizontal sparger comprising a series of inlets positioned below the plating area and oriented to direct plating solution flowing through the inlets directly into one and towards another of the upper and lower channels.

2. The system of claim 1 wherein the sparger directs plating solution flowing through the inlets in a plane substantially coplanar with the plating shields.

3. The system of claim 1 wherein each of the upper channel and lower channel has a width less than or equal to one inch.

4. The system of claim 1 wherein the horizontal sparger directs any plating solution flowing through the inlets into the lower channel and towards the upper channel.

5. The system of claim 1 wherein each of the upper channel and lower channel has a width less than or equal to 0.5 inches.

6. The system of claim 1 further comprising a plurality of part clamps electrically coupled to a power source and positioned within the upper channel or the lower channel.

7. The system of claim 1 wherein at least one of the upper channel and lower channel is adapted to be moved to vary the height of the gaps.

8. The system of claim 1, wherein the gap is 20 percent of the height of the part being plated.

* * * * *

UNITED STATES PATENT AND TRADEMARK OFFICE

CERTIFICATE OF CORRECTION

PATENT NO. : 7,678,243 B2
APPLICATION NO. : 10/765782
DATED : March 16, 2010
INVENTOR(S) : Paul Silinger et al.

It is certified that error appears in the above-identified patent and that said Letters Patent is hereby corrected as shown below:

Title Page; item (30);
The Foreign Application Data should include:

| Date | Code | Application Number |
|---|---|---|
| Feb 21, 2002 | WO | PCT/US02/05536 |
| Jul 7, 2003 | EP | 02707865.8 |

Signed and Sealed this

Eighth Day of June, 2010

David J. Kappos

David J. Kappos
*Director of the United States Patent and Trademark Office*